US009695530B2

(12) United States Patent
Hall

(10) Patent No.: US 9,695,530 B2
(45) Date of Patent: Jul. 4, 2017

(54) APPARATUS TO FACILITATE THE COMMENCEMENT AND EXECUTION OF OFF-LOOM BEAD WEAVING STITCHES AND METHOD(S) OF USING SAME

(76) Inventor: Deborah Jean Hall, Hatfield, PA (US)

( * ) Notice: Subject to any disclaimer, the term of this patent is extended or adjusted under 35 U.S.C. 154(b) by 347 days.

(21) Appl. No.: 13/572,687

(22) Filed: Aug. 12, 2012

(65) Prior Publication Data

US 2013/0038008 A1 Feb. 14, 2013

Related U.S. Application Data

(60) Provisional application No. 61/522,248, filed on Aug. 11, 2011.

(51) Int. Cl.

| | |
|---|---|
| ***B25B 3/00*** | (2006.01) |
| ***D04D 1/04*** | (2006.01) |
| ***D03D 29/00*** | (2006.01) |
| *A47H 23/05* | (2006.01) |
| *A44C 11/00* | (2006.01) |

(52) U.S. Cl.

CPC ..... *D04D 1/04* (2013.01); *D03D 29/00* (2013.01); *A44C 11/002* (2013.01); *A47H 23/05* (2013.01)

(58) Field of Classification Search

USPC ..... 269/1; 248/431

See application file for complete search history.

(56) References Cited

U.S. PATENT DOCUMENTS

| | | | | |
|---|---|---|---|---|
| 752,626 | A * | 2/1904 | Law | D04D 9/00 223/48 |
| 1,160,132 | A * | 11/1915 | Bliss | D03D 29/00 139/33 |
| 2,427,093 | A * | 9/1947 | Eckert | D03D 29/00 139/34 |
| 4,044,446 | A * | 8/1977 | Segerman | B07C 9/00 29/241 |
| 4,160,467 | A * | 7/1979 | Woodruff | D03D 29/00 139/33 |
| 4,522,872 | A * | 6/1985 | Berczi | D06M 11/74 427/393.3 |
| 4,524,170 | A * | 6/1985 | Berczi | D06M 11/74 252/511 |

(Continued)

*Primary Examiner* — Larry E Waggle, Jr.
*Assistant Examiner* — Alvin Grant
(74) *Attorney, Agent, or Firm* — Cusick IP, PLLC; Clinton J. Cusick, Esq.

(57) ABSTRACT

An apparatus that facilitates commencement and execution off-loom bead weaving stitches such as, but not limited to, odd/even count Peyote (Gourd), Two (or more) Drop Peyote, Herringbone (Ndebele), Brick (Comanche/Cheyenne), Right Angle Weave, Netting, and derivative stitches. The apparatus in all embodiments provides means to temporarily secure beads by use of one or more of the following: a nonflexible or flexible filament-with or without aid of a sewing needle, friction, clasping with means to engage and disengage or a releasable adhesive in a format that enables the user to have improved sightline and access to the beads, improved control of bead placement resulting in a reduction of color placement and stitch execution errors, and allows the completed or in progress beadwork to be removed from the apparatus intact. The apparatus may be formatted for bead size and configured or combined to accommodate the width of the desired beadwork.

15 Claims, 8 Drawing Sheets

(56) References Cited

U.S. PATENT DOCUMENTS

| | | | | |
|---|---|---|---|---|
| 4,869,951 | A * | 9/1989 | McCullough, Jr. | D02G 3/441 139/420 A |
| 5,297,591 | A * | 3/1994 | Baurmeister | B01D 63/02 139/383 R |
| 6,991,141 | B2 * | 1/2006 | Ciko | A44C 11/002 223/48 |
| 7,147,008 | B2 * | 12/2006 | Sayler | D03D 29/00 139/11 |
| 7,947,101 | B2 * | 5/2011 | Devine | B01D 46/0005 55/484 |
| 8,066,035 | B1 * | 11/2011 | Stevens | D03D 29/00 139/29 |
| 8,168,381 | B2 * | 5/2012 | Rasmussen | C12N 15/1068 435/6.11 |
| 8,256,362 | B2 * | 9/2012 | Tajima | D05B 3/02 112/102.5 |
| 8,316,894 | B2 * | 11/2012 | Schaub | D03D 29/00 139/1 R |
| 2006/0035548 | A1 * | 2/2006 | Goto | B29B 15/122 442/65 |
| 2008/0289225 | A1 * | 11/2008 | Ali | A41F 17/00 36/70 R |
| 2009/0120525 | A1 * | 5/2009 | Java | B09B 3/00 139/383 A |
| 2009/0193584 | A1 * | 8/2009 | Stewart | A47G 9/0246 5/495 |
| 2014/0096320 | A1 * | 4/2014 | Wilson | A47D 15/008 5/424 |

* cited by examiner

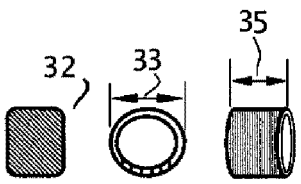
Fig.1
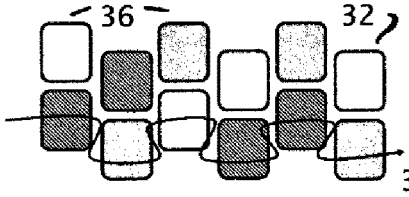
Fig.2
Fig.3A
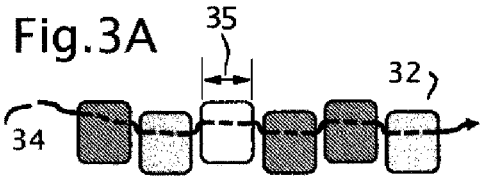
Fig.3B
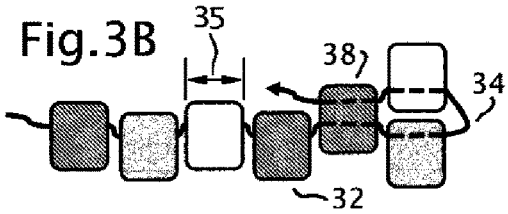
Fig.3C
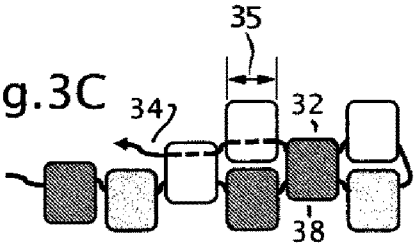
Fig.4A
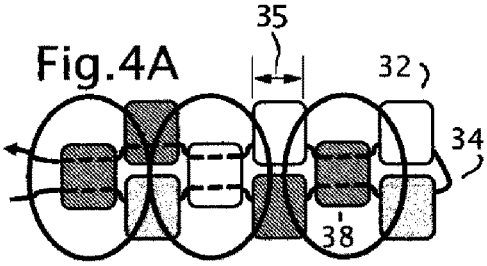
Fig.4B
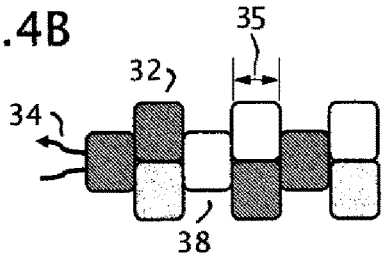
Fig.4C
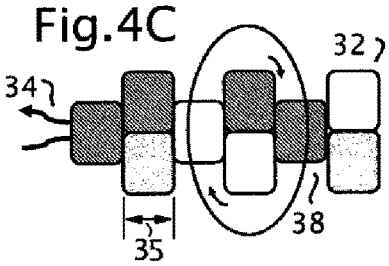
Fig.5A
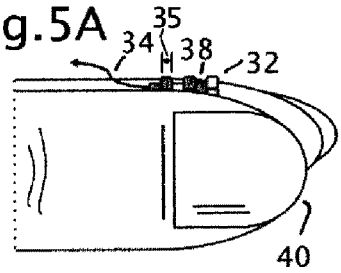
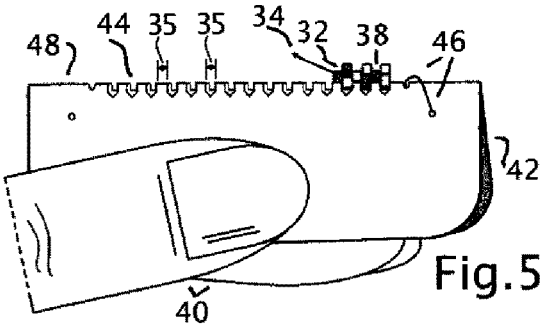
Fig.5B

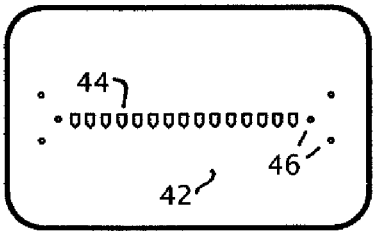
Fig.6
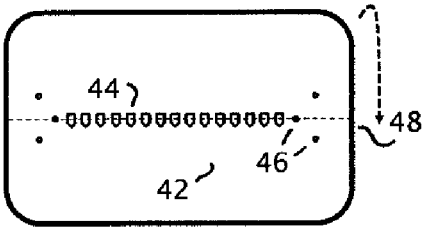
Fig.7A
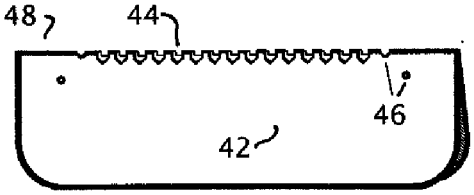
Fig.7B
Fig.8
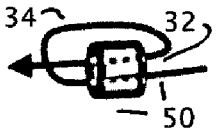
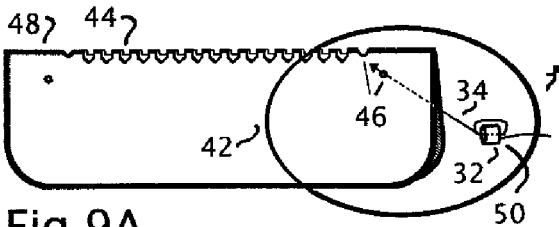
Fig.9A
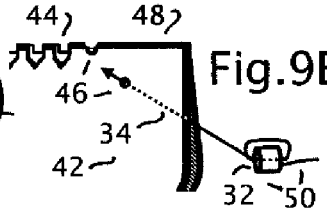
Fig.9B
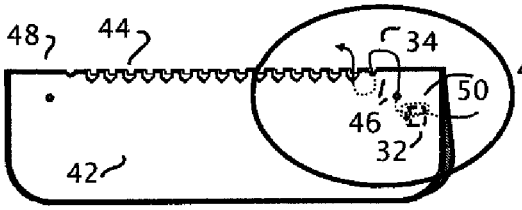
Fig.10A
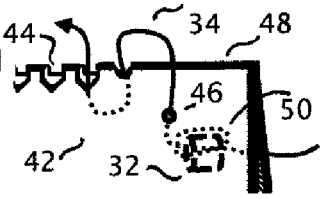
Fig.10B

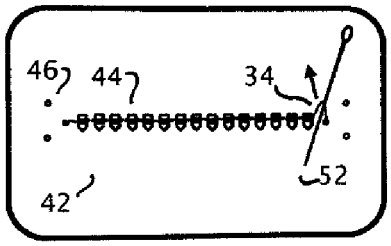
Fig.14A
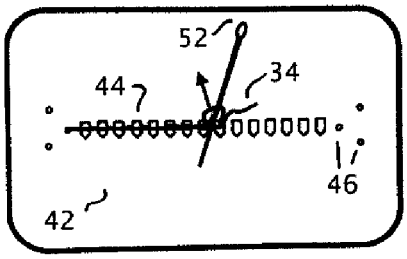
Fig.14B
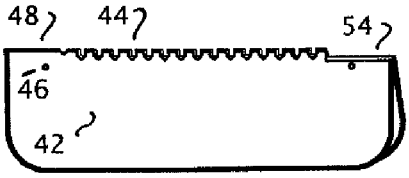
Fig.15A
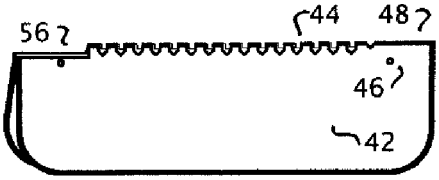
Fig.15B
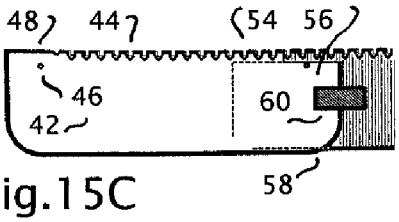
Fig.15C
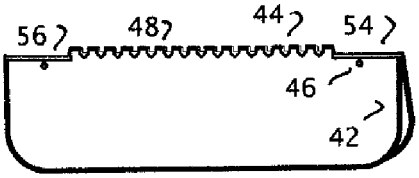
Fig.15D
Fig.16A
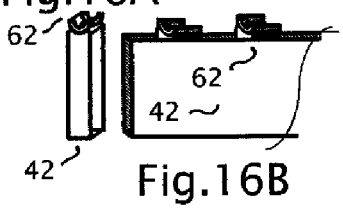
Fig.16B
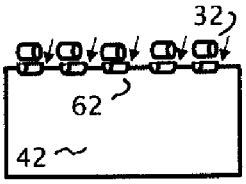
Fig.16C
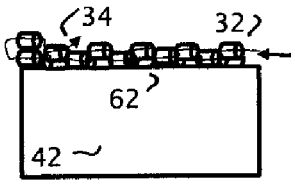
Fig.16D Fig.17A
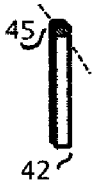
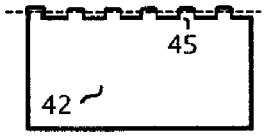
Fig.17B
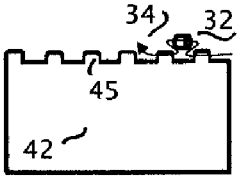
Fig.17C
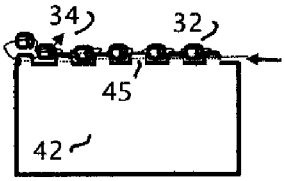
Fig.17D
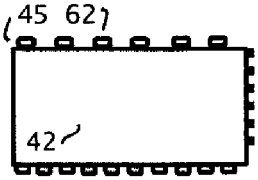
Fig.18
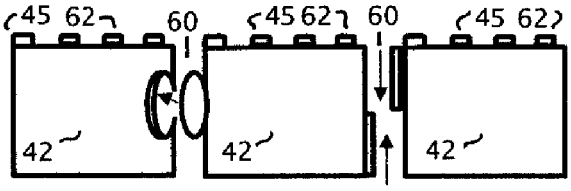
Fig.19A Fig.19B
Fig.20A
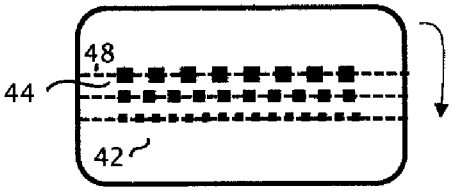
Fig.20B
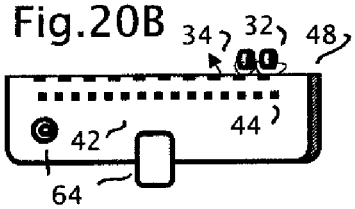
Fig.21A
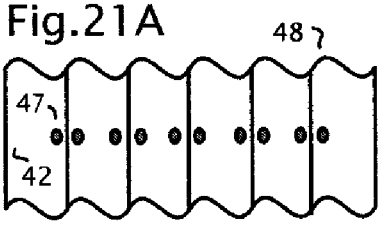
Fig.21B
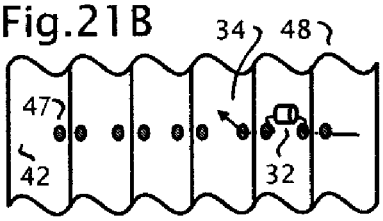
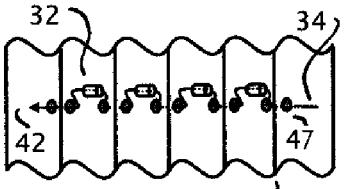
Fig.21C
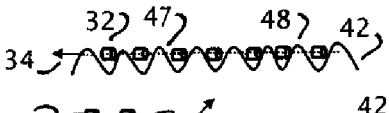
Fig.21D
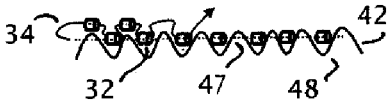
Fig.21E

APPARATUS TO FACILITATE THE COMMENCEMENT AND EXECUTION OF OFF-LOOM BEAD WEAVING STITCHES AND METHOD(S) OF USING SAME

CROSS-REFERENCE TO RELATED APPLICATION

This application claims the benefit of Provisional Patent Application Ser. No. 61/522,248, filed Aug. 11, 2011 by the present inventor.

BACKGROUND

Prior Art

The following is a tabulation of some prior art that presently appears relevant

U.S. Patents

| Pat. No. | Kind Code | Issue Date | Patentee |
|---|---|---|---|
| 8,066,035 | B1 | 2011 Nov. 29 | Stevens |
| 1,726,933 | | 1928 May 11 | G. St. John Jr. |
| 4,785,521 | | 1988 Nov. 22 | Ho |
| .8,051,541 | B2 | 2011 Nov. 08 | Gupta |
| 5,494,734 | | 1996 Feb. 27 | Widders |
| 6,719,013 | B1 | 2004 Apr. 13 | D'Estais |
| 7,147,008 | B2 | 2006 Dec. 12 | Sayler |
| 8,132,596 | | 2012 Mar. 13 | Weidler et al. |
| 6,686,021 | B1 | 2004 Feb. 03 | Case |

Nonpatent Literature Documents

BEADWORK magazine Interweave Press LLC 201 East Fourth Street, Loveland CO.

Bead&Button magazine Kalmbach Publishing Co. 21027 Crossroads Circle Waukesha Wis.

Bead Unique magazine All American Crafts, Inc. P.O. Box 459 Mt Morris, Ill.

Bead Patterns, The Magazine, www.bead-patterns.com

General how-to Glossary Pages any Current Issue

Beadwork is the art or craft of stringing beads together and/or attaching beads to one another or to cloth usually by the use of a needle and thread or other pliable filament. Beadwork may take the form of jewelry, clothing, sculpture, ornamental hangings, and other decorative items. Beads are available in a variety of different designs, sizes, colors, and materials. Beadwork techniques may be broadly divided into stringing, bead embroidery, bead crochet, bead knitting, loom and off-loom weaving.

Simple beadwork projects can be created by hand in a short duration, while complex beadwork may take weeks of meticulous work with specialized tools and equipment.

The most basic form of beadwork is stringing where beads are simply strung sequentially on a thread in a straight line to produce a pleasing configuration. The design possibilities for stringing are limited to linear formats. Off-loom stitches may have any number of beads determine the width.

U.S. Pat. No. 8,066,035 to Stevens discloses a bead stringing apparatus that allows user to pre-string specific groupings of beads onto a temporary thread stretched on a frame. The user can then permanently string additional beads on a separate wire, pass the wire through the pre-aligned bead holes of the bead groupings on the temporary thread and then continue to add random beads between the pre-strung groupings. When the project is complete the temporary thread is removed leaving all beads permanently strung on the wire. While this may speed the stringing process the resulting designs are still limited to linear formats with the beads in single file order, one after another. Off-loom stitches may have any number of beads determine the width and any number determine the length of the finished beadwork.

U.S. Pat. No. 1,726,933 to G. St. John Jr. discloses a bead holding device that facilitates forming a knot in the thread between each bead as it is strung. Pearls are often strung in this manner; if the thread breaks the knots will keep the majority of the beads from sliding off the broken thread. Off-loom stitches do not require knots between the beads; knots may be a hindrance when making the multiple passes through the beads as are required when working off-loom bead stitches.

U.S. Pat. No. 4,785,521 to Ho discloses a method for automatically linking beads or the like. This device suspends a magnetic member in such a way that beads fed into the vicinity of the member can be strung onto the member automatically due to gravity causing a downward pull on the beads once the magnetic member has entered the hole of the bead. This device appears to focus on automatically stringing beads in a straight line. While this may speed the stringing process the resulting designs are still limited to linear formats with the beads in single file order, one after another. Off-loom stitches may have any number of beads determine the width and any number determine the length of the finished beadwork.

U.S. Pat. No. 8,051,541 to Gupta discloses a stringed bead securement device which is used as a temporary brake or stopper so beads cannot slide off one end of the thread or line as the user adds more beads to the other end. There are other traditionally known methods to provide a brake or stopper using beads and/or thread that pre-date this device so this device is not required to work off-loom stitches.

Traditionally bead embroidery, bead crochet, and bead knitting all utilize the same basic tools, and skills as traditional embroidery, crochet, and knitting with the simple addition of beads strung on the threads as they are manipulated by crochet hook or knitting needles or stitched to a substrate with decorative embroidery stitches using a hand sewing needle. Crochet hooks and knitting needles are not used to create off-loom bead stitches. Bead embroidery and off-loom bead stitches both may employ a hand sewing needle to guide the thread through the bead holes but the configuration of embroidery stitches are not the same as those stitches used to create off-loom beadwork since embroidery anchors stitches to a separate substrate such as cloth and off-loom stitches link beads to other beads or to the thread that lies between other beads and requires no other substrate.

U.S. Pat. No. 5,494,734 to Widders discloses a method of stitching beads into the openings in a grid formed by the warp and weft threads of a flexible mesh fabric. The beads are suspended in the openings by passes of additional thread over and under the warp and weft of the mesh fabric. The mesh fabric becomes a permanent supporting substrate of the beadwork. This method shares commonalities with both loom weaving and bead embroidery. This method does not relate to off-loom stitches as no fabric substrate with warp and weft fibers are utilized when stitching off-loom beadwork.

Beadwork may also be constructed on a loom. When weaving on a loom a multitude of threads are strung across opposed ends of the loom structure. These threads are conventionally referred to as warp threads. The beads are positioned and secured between the warp threads by means of one or two passes of a separate weft thread guided by a hand sewing needle suspending a bead or beads between an adjacent pair of warp threads. When the loomed beadwork is completed the multitude of warp threads must be individually secured to maintain the structural integrity of the loom woven beadwork. The user may choose to follow a printed chart or pattern stipulating the relative position of specific color beads in order to reproduce the pattern within the beadwork. Since the loom is traditionally a stand-alone structure it is easy to see all of the threads and beads while user is creating the beadwork and this facilitates following the chart. However the width of the completed beadwork is limited by the size of the loom. Off-loom stitches may have any number of beads determine the width and any number determine the length of the finished beadwork.

U.S. Pat. No. 6,719,013 to D'Estais and U.S. Pat. No. 7,147,008 to Sayler disclose two types of looms specifically adapted for beadwork disclosing a multitude of warp threads on the loom frame as necessary for function. There are numerous additional beading loom designs that all share the need for multiple warp threads to function. Off-loom beadwork does not require a multitude of warp threads or a loom as is indicated by the term Off-loom which specifies that the beadwork is not made on a loom.

U.S. Pat. No. 8,132,596 to Weidler et al. discloses a bead weaving device. This device appears to be a portable beading specific work-station that can stand alone on a table or in the users lap. The device secures the clasp of the jewelry type beadwork with a "toggle half securer", to an angled working surface as a third hand function while the user works the beaded portion of the item. A "Peyote Block Attachment" is described as being removably couplable to the work station base. The positioning of the "Peyote Block Attachment" to the angled work surface is illustrated in FIG. 3 reference number 310. and is stated to be for use in performing peyote stitching. The steps required for use of the "Peyote Block Attachment" are not defined in the summary, the claims, nor demonstrated in the drawings. The method(s) required for attaching the peyote beadwork or beads to, or how the beadwork or beads are engaged by, the "Peyote Block Attachment" is not described or illustrated. It is not specified in what manner the "Peyote Block Attachment" facilitates the stitching of the peyote beadwork. The use of the "Peyote Block Attachment" would not be inherently understood by those familiar with the traditional steps of the off-loom stitch known as peyote by referencing the information and drawings provided by Weidler et al.

Off-Loom beadwork is typically constructed using one thread often with the aid of a hand sewing needle to guide the thread through the bead holes. There are some variations that employ two needles. Traditional Off-loom stitches may include both odd and even bead count versions of Peyote stitch also known as gourd stitch, Two and/or Three-Drop Peyote stitch, Herringbone stitch also known as Ndebele stitch, Brick stitch also known as Comanche or Cheyenne stitch, Right Angle Weave stitch also known by the initials R.A.W., Netting stitches, and the derivative stitches that can be traced back to the aforementioned stitches. Each off-loom stitch produces beadwork with a distinctive format and resulting surface texture produced by how the beads relate to one another within the beadwork. These off-loom stitches are traditionally executed using small, relatively uniformly shaped beads called seed beads. Seed beads come in different sizes which are determined by the quantity of beads strung through the bead holes with each bead touching its preceding and following beads in a single straight thread that will measure approximately an inch. Fifteen size 15 beads when strung on a straight thread will measure approximately an inch, eleven size 11 beads when strung on a straight thread will measure approximately an inch and so on.

The Off-Loom beading stitches begin with the user stringing a predetermined number of beads onto the thread to form the specific base row configuration needed to produce the off-loom bead stitch of choice. The user then employs a stitching sequence, commonly called a thread path, which varies according to the desired stitch formation to join the next bead or grouping of beads to the base row with multiple passes through specific beads or linking passes under the threads present between beads. Each consecutive row builds upon and is linked via thread to the previous row(s).

The base row of beads is usually held by the fingers and thumb of the non-dominant hand of the user while the user performs the steps of the desired stitch with the needle controlled by the dominant hand. The non-dominant, possibly less skillful, hand may find it difficult to hold or control the small beads while working the steps for the desired stitches. This difficulty may result in thread path or stitch formation errors. In addition areas of the base row beads are obscured from view by the user's fingers as the user needs to grasp the base row beads during typical execution of the Off-Loom stitches. It can be difficult to perform the stitch correctly when user's fingers are physically impeding access to the beads, or visually blocking line of sight to the beads due to the need to grasp the base row beads. User may choose to follow a printed chart of a design or pattern stipulating the relative position specific color beads in order to reproduce the printed design or pattern within the beadwork. Following a chart requires that beads of specific colors be strung in a precise order for the base row and that this precise order needs to be maintained throughout the stitching process for the pattern to be reproduced accurately. U.S. Pat. No. 6,686,021 to Case discloses a beading pattern surface and method for creating beadwork which specifies pre-printed beading grids with configurations that match the resulting bead configurations of the completed off-loom bead stitches will act as a guide to help maintain proper thread tension and bead spacing within the resulting beadwork. The Case pattern surface does not address the difficulties inherent with starting the flat off-loom bead stitches but focuses on aiding in maintaining proper bead spacing, thread tension, and bead color placement after the beadwork is already started. The user still needs to hand-hold the base row beads while working the first few rows in order to establish the desired bead configuration before putting the beadwork onto the Case beading surface and aligning the beads to the pre-printed grid. Off-loom stitches often require multiple passes through a centrally located bead, this may create a pivot point or axis where two beads may inadvertently rotate and change position within the first few rows of the beadwork. This may disrupt the desired bead color placement when following a chart of a design or pattern. The rotation of beads out of the desired color sequence may not be noticed by the user until one or more consecutive bead rows are added since portions of the base row beads are obscured may be common when starting the first few rows of Off-Loom bead weaving. These errors may be very frustrating to the user as they require the user to rework sections of the beadwork or start over from the beginning. Two of the major periodicals that specialize in beadwork and related arts such as:

BEADWORK Interweave Press LLC 201 East Fourth Street, Loveland CO.

Bead&Button Kalmbach Publishing Co. 21027 Crossroads Circle Waukesha Wis.

Currently list in their respective reference how-to glossary of stitches sections the troublesome but traditional hand held base row configuration methods of starting off-loom stitches. Thus an apparatus which renders the first few rows of Off-Loom bead weaving easier to observe and/or regulate is novel, unobvious, and desirable.

SUMMARY

In accordance with one embodiment of the apparatus to facilitate the commencement and execution of Off-Loom Bead Weaving Stitches and Method(s) of using same comprises a body with surface area for the user to grasp the apparatus in a way that does not obscure the user view of the beads while executing at least one, or a plurality of rows of Off-Loom Bead Weaving. The embodiment comprises a plurality of holes of pre-determined size. The size and spacing of holes are pre-determined as required to substantially function as a means for releasably engaging thread and/or a plurality of beads relative to the pre-determined bead sizes as a means to regulate and stabilize the beads in a configuration that facilitates the user executing the desired Off-Loom Bead Weaving Stitches.

Advantages

Ideally an apparatus to facilitate the commencement and execution of off-loom bead weaving stitches would provide adequate surface area for the user to grasp the apparatus manually or mechanically in a way that does not obscure the user view of the beads while executing the first few rows of Off-Loom bead weaving. The apparatus would also provide a means to regulate the beads while also limiting undesired rotation of beads out of order while forming the base row(s) giving the user improved control of the small beads. Improved control and a clear sight line would logically result in greater accuracy of color placement and a more successful execution of the desired thread path for the specific Off-Loom bead weaving stitches. The apparatus would be easily dedicated for use with specific bead sizes by altering the size and/or spacing of the bead engagement or thread engagement embodiment to function relative to the pre-determined bead sizes. The apparatus could include an option to increase the stitching area so the apparatus can be used for any size beadwork project.

Other advantages of one or more aspects or embodiments will be apparent from a consideration of the drawings and ensuing description.

DRAWINGS—FIGURES

In the drawings closely related figures have the same number but different alphabetic suffixes.

FIG. 1 Shows a representative bead, side, end, and ¾ view

FIG. 2 Shows a representative pattern or chart for stitching even-count single bead peyote stitch which will be used as a representative off-loom bead weaving stitch throughout. Pattern is read from the bottom up. The convoluted thread path is shown as it would be stitched to connect row one beads and row two beads.

FIGS. 3A-C Show the first steps to commence the off-loom stitch.

FIGS. 4A-C Show the pivot points created when the beads of row 3 are added. Pivot points allow beads from row 1 to exchange places or torque with respect to adjacent beads in row 3.

FIG. 5 A-B Show the relative position of the user fingers when holding first 3 rows of beadwork in progress and user fingers while holding the embodiment of the apparatus with the same first 3 rows of beadwork in progress.

FIG. 6 Shows one embodiment of the apparatus which comprises a panel of flexible material perforated with a multitude of holes or voids in a predetermined configuration and size to correlate to the size of beads to be used to produce off-loom stitches. The holes are positioned such that they leave bridges of un-cut material of a pre-determined size mesial to the voids. The embodiment may also comprise additional voids which may be used to anchor or guide thread.

FIG. 7 Shows the intended fold line and direction of fold of embodiment from FIG. 6

FIG. 8 Shows a stop bead which is a possible means to anchor a thread, additional possible means are illustrated in FIGS. 10C-E FIG. 9A-B Show a possible engagement of the means to anchor a bead from FIG. 8 with the embodiment from FIG. 6 and an enlargement of same.

FIG. 10A-E Show a possible engagement of thread in a void of the embodiment from FIG. 6 in position to commence stitching and enlargement of same. Additional possible means to anchor thread in embodiment from FIG. 6 with or without the use of a stop bead from FIG. 8.

Figure 11:
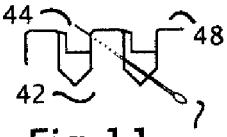

FIG. 11 Shows the pathway of the threaded needle into the extended aperture and under the fold of base material mesial to voids created in FIG. 7 in the embodiment from FIG. 6.

FIG. 12 A-*h* Show possible pathway of thread to engage bead(s) within void(s) of the embodiment from FIG. 6 and an enlargement of the same. With consecutive rows of beads added to the embodiment from FIG. 6 in the peyote stitch format.

FIG. 13 A-B Show possible thread path and bead configurations for Herringbone and Right Angle Weave stitch formats FIG. 14 A-B Show removal of the first row of thread to release beadwork from the embodiment from FIG. 6.

FIG. 15 A-D Show a possible means to increase the usable stitching area by trimming and overlapping units.

FIG. 16 A-D Shows ¾ view and side view of a possible embodiment of the apparatus comprising means to engage beads along one or more edges.

FIG. 17A-D Shows ¾ view and side view of a possible embodiment of the apparatus comprising means to engage thread along one or more edges. Illustrated with and without beads engaged by thread.

FIG. 18 Shows a possible embodiment of the apparatus comprising means to engage thread FIG. 17 or to engage beads FIG. 16 along one or more edges. The different edges may comprise spacing suitable for different size beads.

FIG. 19A-B Show possible mechanical couplings between units to expand stitching surface.

FIG. 20A-B Shows a possible embodiment of the apparatus comprising a multitude of voids with corresponding fold lines as a possible means to engage thread.

FIG. 21A-E Shows a possible embodiment of the apparatus that comprises a series of opposed parallel folds resulting in a plicated surface with a series of voids to engage thread FIG. 17. Front view with and without beads and thread engaged, top view with beads and thread engaged.

Figure 22A:
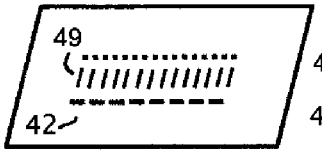
Figure 22B:
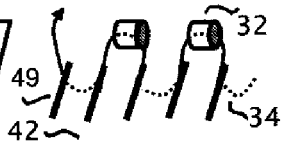
Figure 22C:
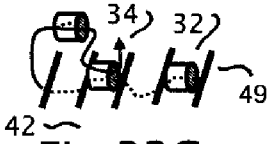

FIG. 22A-C Shows a possible embodiment of the apparatus that comprises a multitude of openings, slits or slots, on a plane to engage thread and/or beads and enlargement of same with beads and thread engaged.

Figure 23A:
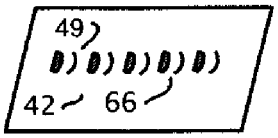
Figure 23B:
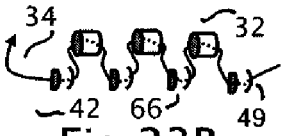
Figure 23C:
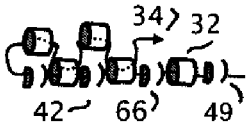

FIG. 23A-C Shows a possible embodiment of the apparatus that comprises a multitude of raised convex arches mesial to openings on a plane to engage thread and enlargement of same with beads and thread engaged.

Figure 24A:
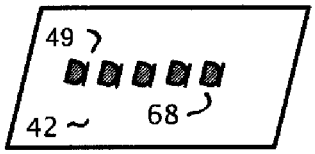
Figure 24B:
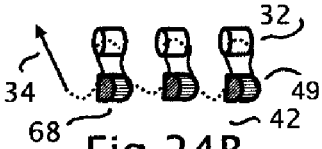

FIG. 24A-B Shows a possible embodiment of the apparatus that comprises a multitude of recessed or concave dimples mesial to openings on a plane to engage thread and enlargement of same with beads and thread engaged.

Figure 25A:
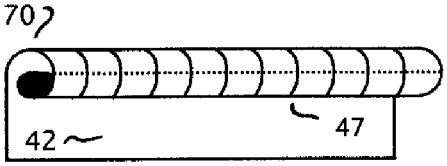
Figure 25B:
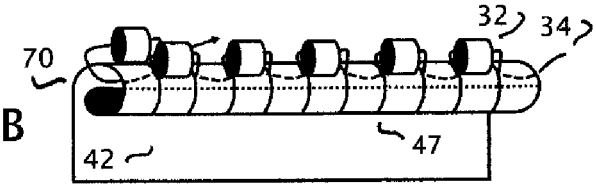

FIG. 25A-B Show a possible embodiment of the apparatus that comprises a flexible or semi-flexible plane with a crispate edge with slits or slots cut into the crispate edge at regular intervals to engage thread shown with and without beads and thread engaged.

Figure 26A:
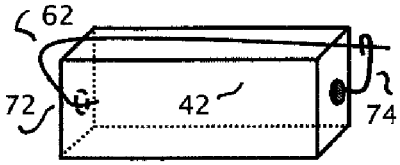
Figure 26B:
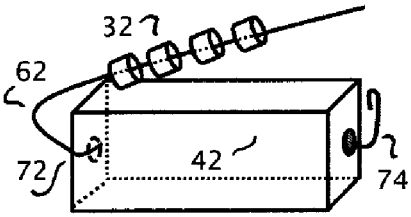
Figure 26C:
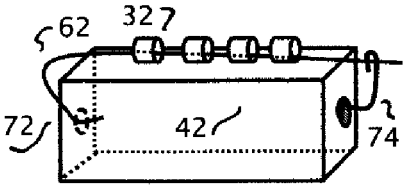
Figure 26D:
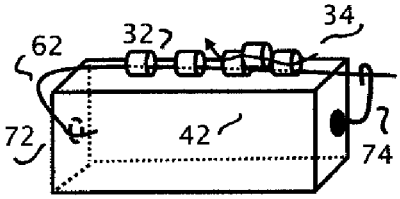
Figure 26E:
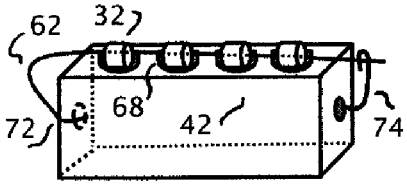
Figure 26F:
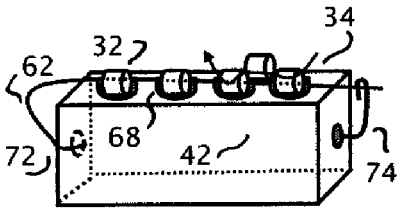

FIG. 26A-F Show a possible embodiment of the apparatus that comprises a wire or plastic filament that is pivotally attached to a base at one end and is releasably attached to the base at the other end of the filament. FIG. 26E-F shows embodiment with the addition of dimples to engage the beads along the plane of the base directly under the filament.

Figure 27A:
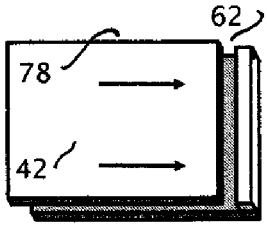
Figure 27B:
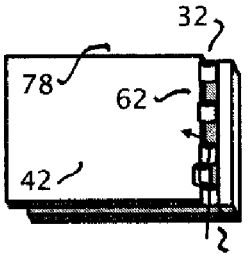

FIG. 27A-B Show a possible embodiment of the apparatus that comprises a base with a raised work stop and another plane traversing the base to create a furrow or rabbit recess to engage beads.

Figure 28:
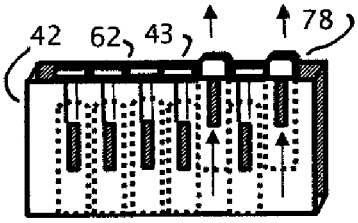

FIG. 28 Shows a possible embodiment of the apparatus that comprises a base with hollows to slidably engage individual units that comprise a means to engage a thread or a means to engage a bead when extended outward from the marge of the opening.

FIG. 29A-H Show a possible embodiment of the apparatus that comprises individual units that comprise a method to engage thread with a means to join units with or without means to provide rotation, ¾ view of single unit and units joined, partial rotation and in use with beads and thread engaged.

FIG. 30A-H Show a possible embodiment of the apparatus that comprises individual units that comprise a method to engage a bead with a means to join units with or without means to provide rotation, ¾ view of single unit and units joined, partial rotation and in use with beads and thread engaged.

DRAWINGS—REFERENCE NUMERALS

32 bead(s)
33 bead width
34 flexible filament or thread/thread path
35 bead length
36 representative chart or patterns[1]
38 rotation point: one bead that shares two threads
40 fingers or gripping device employed by user
42 body of embodiment of the apparatus with adequate surface area to be held manually or mechanically without impeding view of, or access to, beads while in use
43 slot
44 voids
45 hole
46 holes for anchoring and positioning thread
47 filament hole
48 fold(s)
49 slits
50 stop bead: used to stop the forward progression of thread through a hole
52 sewing needle
54 cut away fold right, frustrum right
56 cut away fold left, frustrum left
58 overlap cut ends
60 releasable means to join units[3]
62 releasable means to engage a bead[4]
64 releasable means to secure front plane to back plane in a folded unit
66 raised arches
68 dimple depressions
70 crispate marge or edge of embodiment
72 movable means to secure end of wire or plastic filament to base
74 releasable means to clasp loose end of wire or plastic filament
76 means to join units to allow central rotation, torque
78 means to join units to allow longitudinal nutation on a plane
80 Null spacing area Representative chart or patterns illustrates the off-loom bead weaving stitch single bead peyote but should not be used as a means to limit the use of the apparatus to exclude the other off-loom bead weaving stitches such as but not limited to: both odd and even bead count versions of Peyote stitch also known as gourd stitch, Two and/or Three-Drop Peyote stitch, Herringbone stitch also known as Ndebele stitch, Brick stitch also known as Comanche or Cheyenne stitch, Right Angle Weave stitch also known by the initials R.A.W., Netting stitches, and the derivative stitches that can be traced back to the aforementioned stitches.

Means to engage thread[2] may comprise but is not limited to a hole or void through which the flexible filament or thread may freely pass.

Releasable means to join units[3] may comprise but is not limited to use of friction coupling, adhesive, tongue and grove, hook and loop, male and female, or other mechanical/physical means to join.

Releasable means to engage a bead[4] may comprise but is not limited to friction coupling, adhesive, or other grasping means.

DETAILED DESCRIPTION

The term Bead 32 FIG. 1 may refer to an item with a hole completely passing through its inner plane, beads 32 may indicate the plurality. Seed beads 32 come in a variety of sizes. Size is determined by the quantity of same size beads 32 that can be strung in a straight line that equal or measure one inch. Size 11 beads 32 would string a quantity of 11 beads 32 in an inch. Bead width 33 is shown as the exterior dimension of a bead measured side to side. Bead length 35 is shown as the exterior dimension of a bead measured parallel to a central opening in the bead where a filament would pass through the bead as shown in FIG. 3A.

The term Off-Loom may refer to beadwork constructed by hand with one or two needle 52s and one or two threads as opposed to the multiple warp and weft threads of loom beadwork construction methods. Traditional Off-loom stitches may include both odd and even bead 32 count versions of Peyote stitch also known as gourd stitch, Two and/or Three-Drop Peyote stitch, Herringbone stitch also known as Ndebele stitch, Brick stitch also known as Comanche or Cheyenne stitch, Right Angle Weave stitch also known by the initials R.A.W., Netting stitches, and the derivative stitches that can be traced back to the aforementioned stitches. The stitch know as single bead 32 Peyote FIG. 2-4C is shown for demonstration purposes only and is not to be used to limit the apparatus 42 to that stitch as it works well with the other aforementioned stitch formations The term Thread 34 may refer to any flexible strand-like material which can be manipulated with or without the use of a hand held 40 needles 52 or machine guided needle.

The term Beadwork may refer to an article created with beads 32 and thread 34 as defined herein.

The term User may refer to the person physically manipulating thread 34 with the intent to produce a piece of beadwork consisting of beads 32 of any size or substance joined by thread 34 with or without the aid or use of a hand held 40 needle 52 or machine guided needle 52.

Bead 32 Width 33 may refer to the measurement of a bead 32 at its widest diameter of the bead 32 on the planes that do not comprise the hole(s) the diameter across the bead 32 without regard to the hole.

Bead length 35 may refer to the measurement or diameter of the bead 32 from the plane comprising the opening(s) or hole(s) to the opposite plane with opening(s) or hole(s) which may also be considered the length of the hole(s) through the interior of the bead 32.

Detailed Description—FIGS. 6-11—First Embodiment

One embodiment of the apparatus FIG. 6 may comprise a panel or sheet 42 of rigid or semi-rigid material with a means for folding 48 or a panel or sheet 42 of flexible folding 48 material that can be hand held 40 or placed on a table top for use with or without a means of support and which comprises line(s) or row(s) of a plurality of voids 44 or apertures of square, oval, round, triangular, or irregular configuration or a combination thereof to be called "holes 44 passing completely through the material of a diameter and shape to allow passage of beads 32 and thread 34 through the holes 44 whereas the horizontal orientation of the individual holes 44 are more than 100% of the pre-determined nominal size of the beads 32 but no more than 125% of the pre-determined nominal size of said beads 32 and the perpendicular orientation of the holes 44 are at least 100% of the pre-determined nominal size of said beads 32 but not more than 120% of the pre-determined nominal size of said beads 32 with the optimum size somewhere in between to be determined by the size variance and shape variation due to production or manufacturing methods of the beads 32 to be used with the embodiment of the apparatus 42. The margins of said holes 44 are to be aligned parallel and perpendicular along a straight plane. The upper and lower margins of the holes 44 should lie on the same plane with approximately equal portions of the holes 44 on either side of the intended straight fold 48 line(s) FIG. 7A.

One or more embodiments may comprise an addition of extension(s) to the margin of the holes 44 comprised of a contiguous aperture whereas the connecting hole 44 joining the hole and the aperture is smaller than the starting hole but at least large enough to accommodate the point of a sewing needle 52. The aperture extends beyond the perimeter of said hole 44 to create an accessible entry or ingress into the area under the fold 48 and between the front and back planes of the material when folded 48 FIG. 11 The plurality of holes 44 shall be positioned alternately with areas of un-cut material to be called "bridges" of an approximately equal size as the holes 44 with a width of approximately 80% of the pre-determined nominal size of the beads 32 up to but no more than 125% of the pre-determined nominal size of said beads 32 with the optimum size somewhere in between to be determined by the size variance and shape variation due to production or manufacturing methods of the beads 32 to be used with the embodiment of the apparatus 42. The perpendicular aspect of the uncut material to be determined by the perpendicular aspect of said contiguous holes 44. The embodiment may comprise additional holes 46 of a size and shape to allow only the passage of the sewing needle 52 and thread 34 for use as guides to anchor or position the thread 34 prior to use with the apparatus 42 FIGS. 9A-B, 10A-E.

The outer shape and dimensions of the embodiment of the apparatus 42 may be independently determined or may be regulated by the desired number of holes 44 and the predetermined size of the beads 32 to be used with the apparatus 42. The embodiment shown in FIG. 6 is for illustrative use only and is not to be considered the only or best configuration of the apparatus 42. Outer dimensions of the apparatus 42 may comprise sufficient surface area when folded 48 for the user to grasp the apparatus 42 manually or with a gripping mechanism 40 without impeding the user view of the beads 32 or the manipulation of thread 34 via sewing needle 52 through holes of said beads 32 and holes 44 of the apparatus 42 FIG. 5B.

Operation First Embodiment—FIG. 2, FIG. 5B, FIG. 6, FIGS. 7A-B, FIG. 8, FIGS. 9A-B, FIGS. 10A-E, FIG. 11, FIGS. 12A-H, FIGS. 13A-B, FIGS. 14A-B, FIGS. 15A-D The manner of using the current embodiment of the apparatus 42 for the execution of Off-Loom bead weaving stitches may utilize the representational Off-Loom bead weaving stitch known as Peyote for illustrative purposes, this should not be used to limit the apparatus 42 to this stitch as it works equally well with the other Off-Loom bead weaving stitches.

User folds 48 the apparatus 42 along the fold 48 line indicated in FIG. 7A and creases the material to maintain the folded 48 configuration shown in FIG. 7B. Embodiment must remain folded 48 throughout active use of the apparatus 42 until at least 4 rows of beadwork are completed.

Thread a sewing needle 52 with a length of thread 34, pass threaded needle 52 through a waste bead 32 two times for use as a stop bead 50 or means to stop the forward progression of the thread 34 through a hole 46 of a smaller diameter than the bead 32 FIG. 8.

Figure 10C:
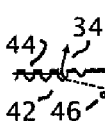
Figure 10D:
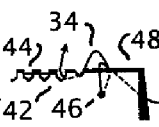
Figure 10E:
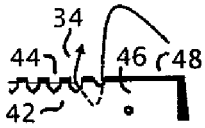

Pass needle 52 under the folded 48 area of the embodiment and out one of the small guide holes 46 in the embodiment FIGS. 9A-B. Draw the thread 34 through to position the stop bead 50 inside the fold 48. Pass needle 52 down through the small guide hole 46 on the fold 48 and exit up through the first large hole 44 FIGS. 10A-B. As stop bead 50 is not necessary to the functionality of the embodiment additional alternative methods of positioning the thread 34 are illustrated by FIGS. 10C-E but other positioning configurations not pictured may work as well. Embodiment must remain folded 48 from this point on throughout active use of the apparatus 42 until at least 4 rows of beadwork are completed.

Figure 12A:
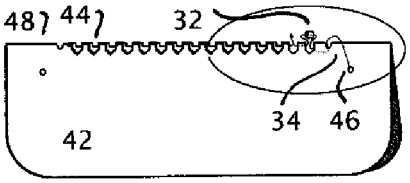
Figure 12B:
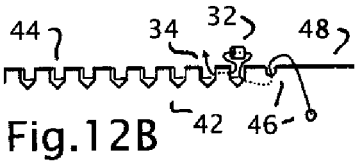
Figure 12C:
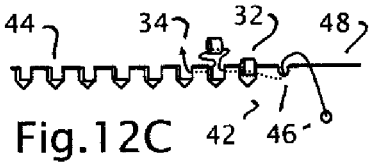
Figure 12D:
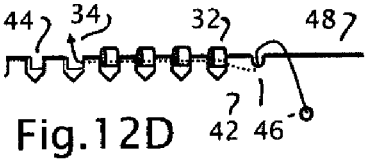
Figure 12E:
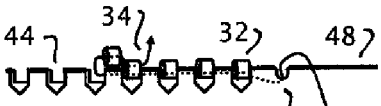
Figure 12F:
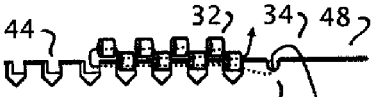

User strings the first bead 32 of the first row onto the needle 52 and passes the needle 52 right to left from the first large hole 44, under the folded 48 material between the voids 44 to exit up through the $2^{nd}$ large hole 44 FIG. 11, FIGS. 12A-B. The user draws the needle 52 and thread 34 through the $2^{nd}$ hole 44 until the first bead 32 is engaged by the first hole 44 and held in position by the interaction of the thread 34 and the apparatus 42. A second bead 32 is strung onto the needle 52 and the needle 52 passes into the $2^{nd}$ hole 44, passing under the folded 48 material between the $2^{nd}$ and $3^{ed}$ voids 44 and exits the $3^{rd}$ hole 44 FIG. 12C. The user repeats the action of stringing a bead 32 and passing under the fold 48 of material that lies mesial to the consecutive voids 44 to position one bead 32 within each hole 44 to achieve a predetermined quantity of beads 32 engaged within the voids 44 of the embodiment equal to the first row of beads 32 FIG. 12D. Note that the user stitches the beads 32 in row number one, one at a time rather than stringing the first and second row alternately all at once as in the traditional method. Adding beads 32 one at a time would improve color position accuracy.

To add the second row of beads 32 the user has the choice of stitching by moving left to right by maintaining the current relative positioning of the a apparatus 42 or the user can turn the apparatus 42 over so the opposite side now presents while maintaining the fold 48 so the user can continue stitching right to left if that direction is preferred. Illustrations show alternating the stitching direction for clarity. Thread 34 exits the $5^{th}$ large hole 44. The first bead 32 in the second row is strung onto the needle 52 and the user passes the needle 52 left to right through the last bead 32 added in the first row. Since the user grasps 40 the apparatus 42 below the area that engages the beads 32 and thread 34 the user sightline or view of the beads 32 is not impeded by the user's fingers 40 as is the case with the traditional method of starting the stitch FIG. 5A. Improved sightline may improve stitch formation and bead 32 color placement. Since the beads 32 are engaged by the apparatus 42 the beads 32 cannot rotate 38 out of color order which may also improve color placement accuracy When the thread 34 is drawn through the last bead 32 in the first row the first bead 32 in the second row may be positioned on top of the folded 48 material mesial to the $5^{th}$ and $4^{th}$ voids 44. This positioning will cause the second row bead 32 to assume an off-set position relative to the beads 32 in the first row FIG. 12E. This off-set or staggered presentation of beads 32 is desirable in the representational stitch known as Peyote. The remaining beads 32 in the second row are added one by one by stringing a bead 32 and passing left-right through the next first row bead 32 to the right until the thread 34 exits the first bead 32 added in the first row and one bead 32 has been added between each first row bead 32 FIG. 12F. Again the opportunity to add the beads 32 one by one rather than stringing the first and second row alternately all at once as in the traditional method greatly improves color position accuracy.

Figure 12G:
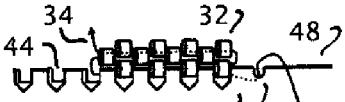

Third row beads 32 are joined to the $2^{nd}$ row beads 32 moving right to left FIG. 12G. In the traditional method of stitching peyote unwanted bead 32 rotation 38 between the first and third rows of beads 32 may occur at this stage but this unwanted rotation 38 cannot occur with the embodiment as the first row beads 32 are engaged with the apparatus 42 and are not free to rotate. The increased control offered by the apparatus 42 greatly reduces the opportunity for beads 32 to rotate out of color order 38.

Figure 12H:
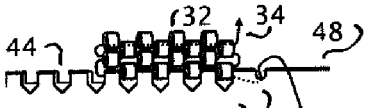

Fourth row of beads 32 are added one by one to the third row beads 32 FIG. 12H. After the fourth row is complete the unwanted bead 32 rotation 38 cannot occur and the beadwork may be removed from the apparatus 42 and completed or beadwork may remain attached to the apparatus 42 as the user continues to add the consecutive rows of beads 32 and removed at a later time.

Figure 13A:
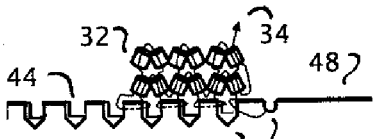
Figure 13B:
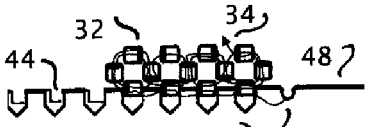

Possible thread 34 path and bead 32 configurations for the Off-Loom stitches known as Herringbone or Ndebele FIG. 13A and Right Angle Weave FIG. 13B are shown on the embodiment of the apparatus 42 but should not be used to limit the use of the apparatus 42 to those stitches as the embodiment works well with other Off-Loom stitches too. Alternately the beadwork process can commence on the opposite side of the embodiment and worked in a mirror image progression if the user so chooses.

To remove the beadwork from the apparatus 42 after at least four bead 32 rows are added the user opens the fold 48 and works from inside the fold 48 where a single line of thread 34 is visible mesial to the voids 44. User removes the stop bead 50 if one was added and then uses the sewing needle 52 to gently un-stitch the thread 34 that crosses between voids 44 FIGS. 14A-B. Removing this thread 34 releases the intact beadwork from the apparatus 42. The embodiment of the apparatus 42 can be used again and again to start additional projects.

To increase the stitching area when using this embodiment of the apparatus 42 the user may cut away the fold 54 area that lies mesial to the first large hole 44 and the right edge of the apparatus 42 FIG. 15A and cut away the fold 56 area that lies mesial to the first last hole 44 and the left edge of the apparatus 42 FIG. 15B then overlap 58 the cut areas so the first remaining large hole 44 from FIG. 15A and the last remaining large hole 44 from FIG. 15B are aligned. Use a means to removably join 60 the two embodiments at the overlap 58 such as, but not limited to, adhesive tape FIG. 15C. If additional stitching area is desired user may remove the fold 48 area from both sides of a third apparatus 42 FIG. 15D, and place this double-cut unit between units from FIG. 15A and FIG. 15B and use a removable means to join 60 the two resulting areas of overlap 58. In this manner the available stitching area can be easily customized by the user. The greater numbers of beads 32 in the starting rows of large Off-Loom beadweaving projects greatly increase the opportunity for beads 32 to rotate out of color order 38 or for the user to make an error in color selection as the longer strings of beads 32 used to start the stitches in the traditional method become unwieldy. Unfortunately it also takes longer to start over if an error is made so the expansion of stitching area of the apparatus 42 is highly desirable to reduce errors while starting larger projects.

Second Embodiment—FIGS. 16A-D 19A-B

Embodiment of the apparatus 42 may comprise a panel or sheet 42 of rigid, semi-rigid, or flexible material that can be hand held 40 or placed on a table top for use with or without a means of support of sufficient thickness that a plurality of raised surfaces of a size and shape to accommodate approximately 50% to 75% the bead width 33 of the desired bead 32 size and 80% to 120% of the pre-determined bead length 35 with a means to temporarily grasp 62 and hold said beads 32 in position until the user wishes to disengage the beads 32 from the embodiment of the apparatus 42 said means may comprise, but are not limited to, friction, clasping with means to engage and disengage or an adhesive. The means to engage 62 a bead 32 may comprise a configuration that alternates the raised means to engage 62 a bead 32 with unaltered base 42 edges to segregate the means to engage 62 a bead 32 to achieve the desired conformation of engaged beads 32 relative to non-engaged beads 32 to facilitate the formation of the desired bead 32 stitches.

The outer shape and dimensions of the embodiment of the apparatus 42 may be independently determined or may be regulated by the desired number of bead engaging 62 means and the predetermined size of the beads 32 to be used with the apparatus 42. The embodiment shown in FIG. 16A-B is for illustrative use only and is not to be considered the only or best configuration of the apparatus 42. Outer dimensions of the apparatus 42 may comprise sufficient surface area for the user to grasp the apparatus 42 manually or with a gripping mechanism 40 without impeding the user view of the beads 32 or the manipulation of thread 34 via sewing needle 52 through holes of said beads 32 engaged by the apparatus 42 16C-D. The embodiment of the apparatus 42 may comprise a mechanical means to releaseably join units 60 of the apparatus 42 to each other in order to expand the stitching area FIGS. 19A-B such as, but not limited to, scarf, hook, docking ferrule, coupling, clamp, loop and hook, adhesive, or adhesive tape, or friction join.

Operation Second Embodiment—FIGS. 16C-D

User temporarily inserts or attaches one bead 32 consecutively from the second row of the desired Off-Loom bead weaving stitch to correlating consecutive bead engagement 62 surfaces on this embodiment of the apparatus 42 FIG. 16C. User threads a sewing needle 52 and passes right to left through the first bead 32 on the right held by the apparatus 42. User strings first bead 32 from the first row onto the needle 52 and passes through the second bead 32 held by the apparatus 42 thus suspending the first row bead 32 between the second row beads 32 by means of the thread 34. User repeats the string a bead 32, pass through a bead 32 held by the apparatus 42. In order to complete the desired first row two beads 32 are added after the last second row bead 32 held by the apparatus 42. One of the two completes the first row and one begins the third row when the user passes left to right through the last second row bead 32 held by the apparatus 42 FIG. 16D.

User completes at least four rows of the desired Off-Loom bead weaving stitch and the beadwork can be disengaged from the embodiment of the apparatus 42 and completed independently. Alternately the beadwork process can commence on the opposite side of the embodiment and worked in a mirror image progression if the user so chooses. Since the user grasps 40 the apparatus 42 below the area that engages the beads 32 the user sightline or view of the beads 32 is not impeded by the user fingers 40 as is the case with the traditional method of starting the stitch. Improved sightline may improve stitch formation and bead 32 color placement. Since the beads 32 are engaged by the apparatus 42 the beads 32 cannot rotate 38 out of color order which may also improve color placement accuracy Third Embodiment—FIGS. 17A-D, 18, 19A-B Embodiment of the apparatus 42 may be comprised of a body 42 of rigid, semi-rigid, or flexible material that can be hand held 40 or placed on a table top for use with or without a means of support of sufficient thickness that a plurality of raised segments along one or more perimeter edges of the embodiment of the apparatus 42 FIGS. 17B, 18 Upper surface plane on the "teeth" of the said striations may be comprised of un-cut material that stands proud in relation to the "notches" or depressions or can be added material that stands proud above the plane of the perimeter of the rest of the embodiment of the apparatus 42 thus creating "notches" or depressions congruently between the added materials. The striations of similar or congruent size and/or shape manifest along a contiguous portion of the perimeter(s) of the embodiment of the apparatus 42. The teeth and/or notches may be of any suitable shape, square, oval, round, triangular, or irregular configuration or a combination thereof that may accommodate the aforementioned beads 32 within the depressions of the notches to an approximate depth of more than 20% of the bead width 33 of bead 32 up to approximately 80% of the desired bead width 33 of bead 32 in relation to the upper plane of the aforementioned "teeth" with the optimum depth from the upper plane of the material to the lowest point the bead 32 touches falling somewhere between to be determined by the size variance and shape variation due to production or manufacturing methods of the beads 32 to be used with the embodiment of the apparatus 42.

The width of the notches or the distance between the teeth that in turn create the notches may be at least 100% of the bead length 35 up to 120% of the bead length 35 (bead length measured from hole to hole in the bead 32) with the optimum width falling somewhere between to be determined by the size variance and shape variation due to production or manufacturing methods of the beads 32 to be used with the embodiment of the apparatus 42 and which may accommodate a hole 45 that passes completely through the interior thickness of the raised "tooth" parallel to or at an angle to the broader surface plane of the material these holes 45 to comprise a diameter and shape adequate in size and configuration to allow passage of a sewing needle 52 with sufficient material remaining around the hole 45 to maintain the integrity of the material that comprises each "tooth".

The outer shape and dimensions of the embodiment of the apparatus 42 may be independently determined or may be regulated by the desired number of thread 34 engaging means and the predetermined size of the beads 32 to be used with the apparatus 42. The embodiments shown in FIGS. 17B, 18, 19A-B are for illustrative use only and is not to be considered the only or best configurations of the apparatus 42. Outer dimensions of the apparatus 42 may comprise sufficient surface area for the user to grasp the apparatus 42 manually or with a gripping mechanism 40 without impeding the user view of the beads 32 or the manipulation of thread 34 via sewing needle 52 through holes of said beads 32 or holes 45 of the embodiment of the apparatus 42. The embodiment of the apparatus 42 may comprise a mechanical means to releaseably join units 60 of the apparatus 42 to each other in order to expand the stitching area FIGS. 19A-B such as, but not limited to, scarf, hook, docking ferrule, coupling, clamp, loop and hook, adhesive, or adhesive tape, or friction join.

Operation Third Embodiment FIGS. 14A-B, 17C-D

User threads a sewing needle 52 and passes right to left through the first thread engagement hole 45 on the right on the apparatus 42. User strings first bead 32 from the right side of the first row of the desired Off-Loom stitch onto the needle 52 and passes right to left through the second thread engagement hole 45 on the apparatus 42 thus suspending the first row bead 32 between the first thread engagement hole 45 and second thread engagement hole 45 by means of the thread 34 FIG. 17C. User repeats the process to string a bead 32 and, pass needle 52 through a thread engagement hole 45 on the apparatus 42 to complete the first row of the desired Off-Loom bead weaving stitch.

First bead 32 of the second row is strung and the user passes left to right through the last first row bead 32 held by thread engagement holes 45 and thread 34 FIG. 17D. Progressive rows of beads 32 are added in a like manner traversing right to left and left to right. Alternately the beadwork process can commence on the opposite side of the embodiment and worked in a mirror image progression if the user so chooses.

User completes at least four rows of the desired Off-Loom bead weaving stitch and the beadwork can be disengaged from the embodiment of the apparatus 42 by removing the thread 34 from the thread engagement holes 45 using the sewing needle 52 in a similar function as shown in FIGS. 14A-B or by other means to remove. Since the user grasps 40 the apparatus 42 below the area that engages the thread 34 the user sightline or view of the beads 32 is not impeded by the user fingers 40 as is the case with the traditional method of starting the stitch. Improved sightline may improve stitch formation and bead 32 color placement. Since the beads 32 are engaged by the apparatus 42 the beads 32 cannot rotate 38 out of color order which may also improve color placement accuracy Fourth Embodiment—FIG. 20A This embodiment of the apparatus may be comprised of a body 42 of semi-rigid, or flexible material that can be hand held 40 or placed on a table top for use with or without a means of support of sufficient thickness and which comprises lines or rows of a plurality of voids 44 or apertures of square, oval, round, triangular, or irregular configuration or a combination thereof to be called voids 44 passing completely through the material 42 of a diameter and shape to allow passage of beads 32 and thread 34 through the voids 44 whereas the horizontal orientation of the individual voids 44 are more than 100% of the pre-determined nominal size of the beads 32 but no more than 125% of the pre-determined nominal size of said beads 32 and the perpendicular orientation of the voids 44 are at least 100% of the pre-determined nominal size of said beads 32 but not more than 120% of the pre-determined nominal size of said beads 32 with the optimum size somewhere in between to be determined by the size variance and shape variation due to production or manufacturing methods of the beads 32 to be used with the embodiment of the apparatus 42. The margins of said voids 44 are to be aligned parallel and perpendicular along a straight plane. The size and relative placement of the voids 44 within a line shall correspond to the dimensions of a specific predetermined bead 32 size whereas each line of voids 44 engages a different bead 32 size. The upper and lower margins of the ranks of voids 44 should lie on the same plane with approximately equal portions of the voids 44 on either side of the intended straight fold 48 lines The outer shape and dimensions of the embodiment of the apparatus 42 may be independently determined or may be regulated by the desired number of voids 44 and the predetermined size of the beads 32 to be used with the apparatus 42 and the quantity of rows of voids 44 desired. The embodiment shown in FIG. 20A is for illustrative use only and is not to be considered the only or best configurations of the embodiment of the apparatus 42. Outer dimensions of the apparatus 42 may comprise sufficient surface area for the user to grasp 40 the apparatus 42 when folded 48 FIG. 20B manually or with a gripping mechanism 40 without impeding the user view of the beads 32 or the manipulation of thread 34 via sewing needle 52 through holes of said beads 32 or voids 44 of the embodiment of the apparatus 42.

The embodiment of the apparatus 42 may comprise a mechanical means to releaseably join the front plane to the back plane of the apparatus 42 when folded 48 such as, but not limited to, scarf, snap, hook, docking ferrule, coupling, clamp, loop and hook, adhesive, or adhesive tape, detent, or friction join FIG. 20B.

Operation Fourth Embodiment FIGS. 12A-H, FIGS. 13A-B, FIGS. 14A-B, 20B Operation of this embodiment correlates to the operation of the first embodiment 12A-H, FIGS. 13A-B, FIGS. 14A-B, in regards to FIG. 20B Fifth Embodiment—FIG. 21A This embodiment comprises a sheet 42 of semi-rigid, or flexible material that comprises a series of opposed parallel folds 48 resulting in a plicated surface that can be hand held 40 or placed on a table top for use with or without a means of support of sufficient thickness and which comprises line(s) or row(s) of a plurality of filament holes 47 or apertures of square, oval, round, triangular, or irregular configuration or a combination thereof to be called filament holes 47 passing completely through the material of a diameter and shape to allow passage of a needle 52 and thread 34 through the filament holes 47.

The configuration of said filament holes 47 may comprise pairs of filament holes 47 aligned and appositionally located on the two planes of the forward folds 48 at a distance from the crest of the fold 48 to an approximate depth of more than 20% of the bead width 330 of bead 32 up to approximately 80% of the desired bead width 33 of bead 32 in relation to the upper plane of the crest of the folds 48. The pairs of filament holes 47 are aligned when the plicated folds 48 are compressed FIG. 21A. The depth of the aft facing folds 48 is determined independent of the bead 32 sizes.

The outer shape and dimensions of the embodiment of the apparatus 42 may be independently determined or may be regulated by the desired number of filament holes 47 and the predetermined size of the beads 32 to be used with the apparatus 42. The embodiments shown in FIG. 21A is for illustrative use only and is not to be considered the only or best configurations of the embodiment of the apparatus 42. Outer dimensions of the apparatus 42 may comprise sufficient surface area for the user to grasp 40 the apparatus 42 when folded 48 FIG. 21A manually or with a gripping mechanism 40 without impeding the user view of the beads 32 or the manipulation of thread 34 via sewing needle 52 through holes of said beads 32 or filament holes 47 of the embodiment of the apparatus 42.

Operation of Fifth Embodiment FIGS. 21B-E

User threads a sewing needle 52 and passes right to left through the first pair of filament holes 47 on the forward fold 48 to the right on the apparatus 42. User strings first bead 32 from the right side of the first row of the desired Off-Loom stitch onto the needle 52 and passes right to left through the second pair of filament holes 47 on the second forward facing fold 48 of the apparatus 42 thus suspending the first row bead 32 between the first filament hole 47 and filament hole 47 by means of the thread 34 FIG. 21B. User repeats the process to string a bead 32 and pass needle 52 through a pair of filament holes 47 on the apparatus 42 to complete the first row of the desired Off-Loom bead weaving stitch 21C and top view 21D.

First bead 32 of the second row is strung and the user passes left to right through the last first row bead 32 held by thread 34 between the last two pair of filament holes 47 FIG.

21E. Progressive rows of beads 32 are added in a like manner traversing right to left and left to right. Alternately the beadwork process can commence on the opposite side of the embodiment and worked in a mirror image progression if the user so chooses.

User completes at least four rows of the desired Off-Loom bead weaving stitch and the beadwork can be disengaged from the embodiment of the apparatus 42 by removing the thread 34 from the filament holes 44. Since the user grasps 40 the apparatus 42 below the area that engages the thread 34 and thus the beads 32 the user sightline or view of the beads 32 is not impeded by the user fingers 40 as is the case with the traditional method of starting the stitch. Improved sightline may improve stitch formation and bead 32 color placement. Since the beads 32 are engaged by the apparatus 42 the beads 32 cannot rotate 38 out of color order which may also improve color placement accuracy Sixth, Seventh, and Eighth Embodiments FIGS. 22A-C, 23A-C, 24A-B These Embodiments of the apparatus 42 are of similar nature and may be grouped as such, they may comprise a sheet 42 of rigid, semi rigid, flexible material and may comprise line(s) or row(s) of a plurality of, slits 49, slots or apertures of square, oval, round, triangular, or irregular configuration or a combination thereof to be called slits 49 passing completely through the material (42) of a diameter and shape to allow passage of thread 34 through the slits 49 whereas the horizontal orientation of the individual slits 49 are more than 100% of the pre-determined nominal size of the beads 32 but no more than 125% of the pre-determined nominal size of said beads 32 and the perpendicular orientation of the slits 49 are at least 100% of the pre-determined nominal size of said beads 32 but not more than 120% of the pre-determined nominal size of said beads 32 with the optimum size somewhere in between to be determined by the size variance and shape variation due to production or manufacturing methods of the beads 32 to be used with the embodiment of the apparatus 42. The margins of said slits 49 are to be aligned parallel and perpendicular along a straight plane FIG. 22A. The areas between the slits 49 may be raised into arches 66 FIG. 23A, or depressed into dimples 68 FIG. 24A.

The outer shape and dimensions of the embodiments of the apparatus 42 may be independently determined or may be regulated by the desired number of slits 49 and the predetermined size of the beads 32 to be used with the apparatus 42. The embodiments shown in FIG. 22A, FIG. 23A, and FIG. 24A are for illustrative use only and are not to be considered the only or best configurations of the embodiments of the apparatus 42. Outer dimensions of the apparatus 42 may comprise sufficient surface area for the user to grasp the apparatus 42 manually or with a gripping mechanism 40 without impeding the user view of the beads 32 or the manipulation of thread 34 via sewing needle 52 through holes of said beads 32 or slits 49 of the embodiment of the apparatus 42.

Operation of Sixth, Seventh, Eighth Embodiments—FIG. 22B-C, FIG. 23B-C, FIG. 24B User threads a sewing needle 52 and passes from under the plane of the apparatus 42 upwards through the first slit 49, strings first bead 32 in first row of the desired Off-Loom bead weaving stitch and pass down from the top plane of the apparatus 42 through the second hole 44 to the left thus suspending the first row bead 32 on the top plane of the apparatus 42 between the first slit 49 and the second thread engagement hole by means of the thread 34 FIG. 22B, FIG. 23B, and FIG. 24B. User repeats the process to string a bead 32 and, pass needle 52 down a slit 49 and up the next in the progression on the apparatus 42 to complete the first row of the desired Off-Loom bead weaving stitch.

First bead 32 of the second row is strung and the user passes left to right through the last first row bead 32 held by thread 34 between the slits 49 FIG. 22C, FIG. 23C. Progressive rows of beads 32 are added in a like manner traversing right to left and left to right. Alternately the beadwork process can commence on the opposite side of the embodiment and worked in a mirror image progression if the user so chooses.

User completes at least four rows of the desired Off-Loom bead weaving stitch and the beadwork can be disengaged from the embodiment of the apparatus 42 by removing the thread 34 from the slits 49.

Since the user grasps 40 the apparatus 42 at a distance from the area that engages the thread 34 and thus the beads 32 the user sightline or view of the beads 32 is not impeded by the user fingers 40 as is the case with the traditional method of starting the stitch. Improved sightline may improve stitch formation and bead 32 color placement. Since the beads 32 are engaged by the apparatus 42 the beads 32 cannot rotate 38 out of color order which may also improve color placement accuracy Ninth Embodiment—FIGS. 25A-B Embodiment may comprise a sheet 42 of semi rigid, or flexible material and may comprise a crispate 70 edge that is segmented by a plurality of voids, slits, slots to create filament holes 47 passing completely through the material (42) of a diameter and shape to allow passage of thread 34 through the filament holes 47 whereas the horizontal orientation of the individual filament holes 47 are more than 100% of the pre-determined nominal size of the beads 32 but no more than 125% of the pre-determined nominal size of said beads 32 and the perpendicular orientation of the filament holes 47 are at least 100% of the pre-determined nominal size of said beads 32 but not more than 120% of the pre-determined nominal size of said beads 32 with the optimum size somewhere in between to be determined by the size variance and shape variation due to production or manufacturing methods of the beads 32 to be used with the embodiment of the apparatus 42. The margins of said filament holes 47 are to be aligned parallel and perpendicular along a straight plane FIG. 25A and may or may not extend to the edge or marge of the crispate 70 portion of the sheet 42.

The outer shape and dimensions of the embodiments of the apparatus 42 may be independently determined or may be regulated by the desired number of filment holes 47 and the predetermined size of the beads 32 to be used with the apparatus 42. The embodiments shown in FIG. 25A is for illustrative use only and is not to be considered the only or best configurations of the embodiments of the apparatus 42. Outer dimensions of the apparatus 42 may comprise sufficient surface area for the user to grasp the apparatus 42 manually or with a gripping mechanism 40 without impeding the user view of the beads 32 or the manipulation of thread 34 via sewing needle 52 through holes of said beads 32 or filament holes 47 of the embodiment of the apparatus 42.

Operation of Ninth Embodiment—FIG. 25B

User threads a sewing needle 52 and passes from under the plane of the apparatus 42 upwards through the filament hole 47, Strings first bead 32 in first row of the desired Off-Loom bead weaving stitch and pass down from the top plane of the apparatus 42 through the second filament hole 47 to the left thus suspending the first row bead 32 on the top plane of the apparatus 42 between the first filament hole 47 and the second filament hole 47 by means of the thread 34 FIG. 25B. User repeats the process to string a bead 32 and, pass needle 52 up a filament hole 47 and down the next in the progression on the apparatus 42 to complete the first row of the desired Off-Loom bead weaving stitch.

First bead 32 of the second row is strung and the user passes left to right through the last first row bead 32 held by thread 34 between the filament holes 47 FIG. 25B. Progressive rows of beads 32 are added in a like manner traversing right to left and left to right. Alternately the beadwork process can commence on the opposite side of the embodiment and worked in a mirror image progression if the user so chooses.

User completes at least four rows of the desired Off-Loom bead weaving stitch and the beadwork can be disengaged from the embodiment of the apparatus 42 by removing the thread 34 from the filament holes 47.

Since the user grasps 40 the apparatus 42 below the area that engages the thread 34 and the beads 32 the user sightline or view of the beads 32 is not impeded by the user fingers 40 as is the case with the traditional method of starting the stitch. Improved sightline may improve stitch formation and bead 32 color placement. Since the beads 32 are engaged by the apparatus 42 the beads 32 cannot rotate 38 out of color order which may also improve color placement accuracy Tenth Embodiment—FIG. 26A This embodiment comprises a base 42 of rigid or semi rigid material that may be of any 3-dimensional form that comprises at least one flat plane, cube, oval, rectangular, circular, or any combination thereof. The outer shape and dimensions of the embodiments of the apparatus 42 may be independently determined or may be regulated by the desired number of beads 32 of a predetermined size, said beads 32 to be used with the apparatus 42.

The embodiments shown in FIG. 26A is for illustrative use only and is not to be considered the only or best configurations of the embodiments of the apparatus 42. Outer dimensions of the apparatus 42 may comprise sufficient surface area for the user to grasp the apparatus 42 manually or with a gripping mechanism 40 without impeding the user view of the beads 32 or the manipulation of thread 34 via sewing needle 52 through holes of said beads 32 while engaged by of the embodiment of the apparatus 42.

The embodiment may comprise a rigid, semi-rigid, or flexible wire or plastic filament to removably engage 62 beads 32 and that is movably attached to one face of the base 42 and which spans the distance across the flat plane of the base 42 and extends a pre-determined distance beyond the apositional plane of the base 42 in relation to the attachment. This movability may be achieved through use of a means to articulate such as, but not limited to, a hinge, toggle, ball and socket, spring, cord, or pivot and may be permanently or temporarily affixed to the base 42. The pre-determined gauge of the filament to be of a thickness in relation to the desired bead 32 size to be engaged to provide adequate remaining space within the bead 32 while engaged by the filament for the passage of a sewing needle 52 and thread 34.

The embodiment may comprise a means to releasably clasp the free end of the filament, this means to clasp may comprise a clamp, a hook, hook and loop, snare/loop, button, coupling, snap, or friction docking and may be permanently or temporarily affixed to the base 42.

Operation of the Tenth Embodiment—FIGS. 26B-F

User releases the filament from the means to clasp and strings all of the first row beads 32 onto the filament FIG. 26B and secures the means to clasp with the beads 32 held on the flat plane of the embodiment by the filament FIG. 26C.

User threads a sewing needle 52 and passes right to left through the first bead 32 held on the filament, user strings the first bead 32 in the second row of the desired Off-Loom stitch and passes right to left through the second bead 32 held by the filament FIG. 26D. The first bead 32 of the second row is suspended between the first and second beads 32 held by the filament by the thread 34. User repeats this process to add one second row bead 32 between or mesial to each of the first row beads 32 held by the filament in accordance with the desired Off-Loom bead weaving stitch.

Progressive rows of beads 32 are added in a like manner traversing right to left and left to right. Alternately the beadwork process can commence on the opposite side of the embodiment and worked in a mirror image progression if the user so chooses.

User completes at least four rows of the desired Off-Loom bead weaving stitch then the beadwork can be disengaged from the embodiment of the apparatus 42 by releasing the means to clasp and sliding the beads 32 off of the filament.

Since the user grasps 40 the apparatus 42 below the area that engages the thread 34 and the beads 32 the user sightline or view of the beads 32 is not impeded by the user fingers 40 as is the case with the traditional method of starting the stitch. Improved sightline may improve stitch formation and bead 32 color placement. Since the beads 32 are engaged by the apparatus 42 the beads 32 cannot rotate 38 out of color order which may also improve color placement accuracy Eleventh Embodiment—FIG. 27A This embodiment may comprise a rigid base 42 and an additional rigid or semi rigid segment with appositional planes joined with a means to nutate along parallel and contiguous planes. The rigid base 42 may comprise a raised work stop whereas the interaction of the base 42 and the second segment creates a furrow or rabbit recess to temporarily engage beads 62 FIG. 27A. The depth of the furrow is determined by the thickness of the secondary segment and may comprise a thickness equal to at least 50% of the bead width 33 of said beads 32 to no more than 75% of the bead width 33 of said beads 32.

The outer shape and dimensions of the embodiments of the apparatus 42 may be independently determined or may be regulated by the desired number of beads 32 of a predetermined size, said beads 32 to be used with the apparatus 42.

The embodiment shown in FIG. 27A is for illustrative use only and is not to be considered the only or best configurations of the embodiment of the apparatus 42. Outer dimensions of the apparatus 42 may comprise sufficient surface area for the user to grasp the apparatus 42 manually or with a gripping mechanism 40 without impeding the user view of the beads 32 or the manipulation of thread 34 via sewing needle 52 through holes of said beads 32 while engaged by of the embodiment of the apparatus 42.

Operation of the Eleventh Embodiment—FIG. 27B

User engages the first row beads 32 in the furrow of the apparatus 42 allowing space equal to the length of one bead 32 between the first row beads 32

User threads a sewing needle 52 and passes right to left through the first bead 32 held in the furrow, user strings the first bead 32 in the second row of the desired Off-Loom stitch and passes right to left through the second bead 32 held in the furrow FIG. 27B. The first bead 32 of the second row is suspended between the first and second beads 32 in the furrow by the thread 34. User repeats this process to add one second row bead 32 between or mesial to each of the first row beads 32 in the furrow in accordance with the desired Off-Loom bead weaving stitch.

Progressive rows of beads 32 are added in a like manner traversing right to left and left to right. Alternately the beadwork process can commence on the opposite side of the embodiment and worked in a mirror image progression if the user so chooses.

User completes at least four rows of the desired Off-Loom bead weaving stitch then the beadwork can be disengaged from the embodiment of the apparatus 42 by releasing the beads 32 from the furrow.

Since the user grasps 40 the apparatus 42 below the area that engages the thread 34 and the beads 32 the user sightline or view of the beads 32 is not impeded by the user fingers 40 as is the case with the traditional method of starting the stitch. Improved sightline may improve stitch formation and bead 32 color placement. Since the beads 32 are engaged by the apparatus 42 the beads 32 cannot rotate 38 out of color order which may also improve color placement accuracy Twelfth Embodiment—FIG. 28, FIGS. 29A-H, FIGS. 30A-H Twelfth embodiment version#1 may comprise a plurality of individual segments of rigid, semi-rigid, or flexible material 42, FIG. 29A, that can be hand held 40, contained in an outer structure FIG. 28 or placed on a table top for use with or without a means of support and of sufficient thickness which may accommodate a slot 43 that passes completely through the interior thickness of each or alternating segment(s) parallel to or at an angle to the broader surface plane of the material these slot 43 to comprise a diameter and shape adequate in size and configuration to allow passage of a sewing needle 52 with sufficient material remaining around the slot 43 to maintain the integrity of the material that comprises each segment. The width of the segments may be at least 100% of the bead length 35 up to 120% of the bead length 35 (bead length measured from hole to hole in the bead 32) with the optimum width falling somewhere between to be determined by the size variance and shape variation due to production or manufacturing methods of the beads 32 to be used with the embodiment of the apparatus 42.

The means of manipulation of the parts into required position may comprise but are not limited to joining with a means to rotate the segments on a fixed axis 76 FIGS. 29B-D that lies below the center plain by the desired perpendicular aspect of the depth of the notches so when a segment is rotated to 180 degrees of its starting location The segments may also comprise means to join and nutate 78 FIG. 29C. The segments may also comprise both the means to engage a thread 34 and the null 80 spacing area needed to provide the proper spacing between means to engage thread 34 when executing the Off-Loom bead weaving stitches FIG. 29H with means to join units together 60.

Figures 29A, 29B, 29C, 29D, 29E:
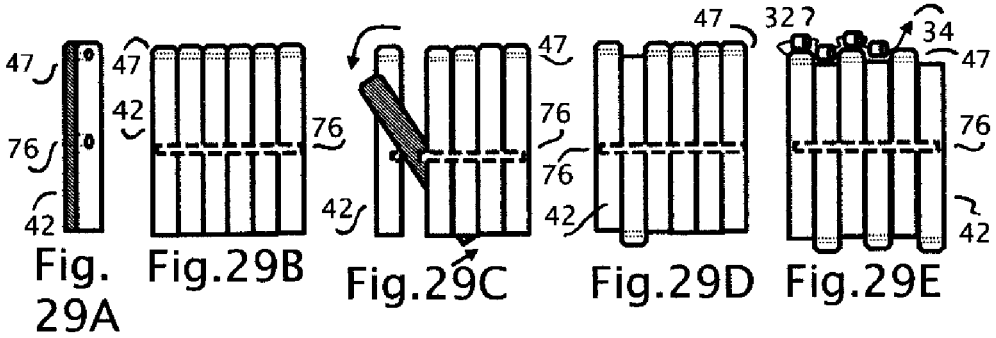
Figures 29F, 29G, 29H:
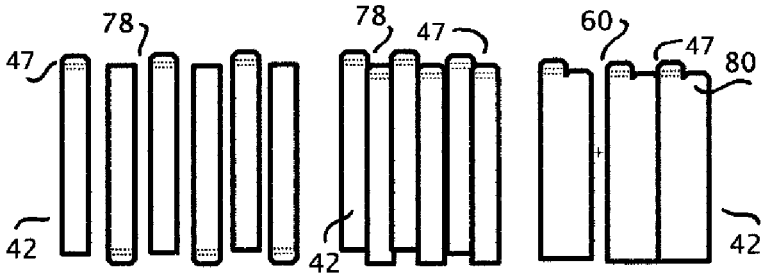

The embodiment shown in FIG. 29A is for illustrative use only and is not to be considered the only or best configurations of the embodiments of the apparatus 42. Lower dimensions of the apparatus 42 may comprise sufficient surface area for the user to grasp the apparatus 42 manually or with a gripping mechanism 40 without impeding the user view of the beads 32 or the manipulation of thread 34 via sewing needle 52 through holes of said beads 32 or through filament holes 47 of the embodiment of the apparatus 42.

Figures 30A, 30B, 30C, 30D:
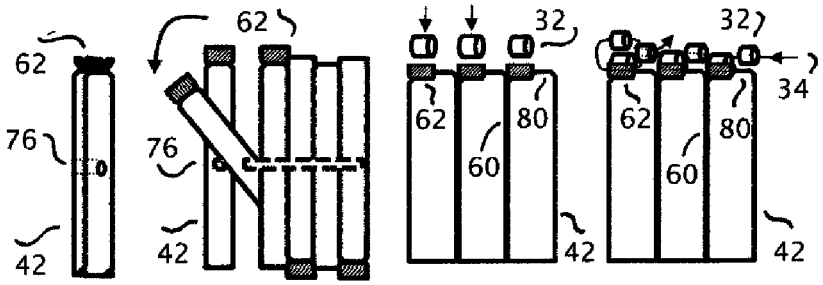
Figures 30E, 30F, 30G, 30H:
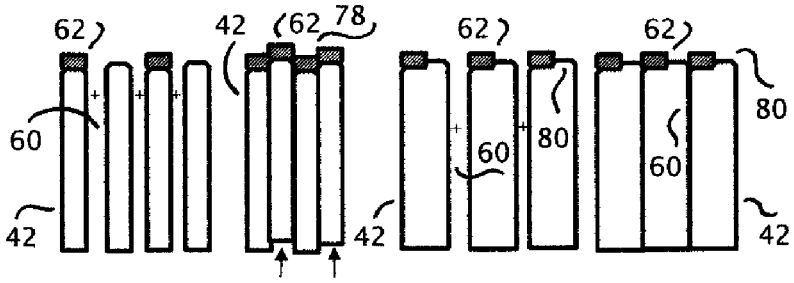

Twelfth embodiment version #2 of the apparatus may comprise a plurality of individual segments of rigid, semi-rigid, or flexible material FIG. 30A that can be hand held 40, contained in an outer structure FIG. 28 or placed on a table top for use with or without a means of support and of sufficient thickness which may accommodate a raised surface of a size and shape to accommodate a single bead 32 of desired size: approximately 50% to 75% the bead width 33 of the desired bead 32 size and 80% to 120% of the pre-determined bead length 35 with a means to temporarily grasp and hold 62 said bead 32 in position until the user wishes to disengage the bead 32 from the embodiment of the apparatus 42 said means 62 may comprise, but are not limited to, friction, clasping with means to engage and disengage or an adhesive. The segments may be held together on a flat plane in respect to each other by some means 60 and can be manipulated into the desired position as regards to spacing and height to accommodate the aforementioned beads 32. The means of manipulation of the parts into required position may comprise but are not limited to joining with a means to rotate the segments on a fixed axis 76 FIG. 30B that lies below the center plain by the desired perpendicular aspect of the depth of the notches so when a segment is rotated to 180 degrees of its starting location. The segments may also comprise means to join and nutate 78 FIG. 30F. The segments may also comprise both the means to engage 62 a bead and the null 80 spacing area needed to provide the proper spacing between means to engage 62 beads 32 when executing the Off-Loom bead weaving stitches FIG. 30C with means to join units together 60.

The embodiment shown in FIG. 30A is for illustrative use only and is not to be considered the only or best configuration of the embodiment of the apparatus 42. Lower dimensions of the apparatus 42 may comprise sufficient surface area for the user to grasp the apparatus 42 manually or with a gripping mechanism 40 without impeding the user view of the beads 32 or the manipulation of thread 34 via sewing needle 52 through holes of said beads 32 while engaged by of the embodiment of the apparatus 42.

Operation of the Twelfth Embodiment—FIG. 29E, FIGS. 30C-E

User assembles or rotates the individual units into the configuration that best suits the Off-Loom bead weaving stitch they wish to execute.

User threads a needle 52 and attaches the first row of beads 32 between the thread 34 engaging units FIG. 29E or the user attaches the first row beads 32 directly to the bead 32 engaging units FIG. 30C.

Row two beads 32 are added via needle 52 and thread 34 to lie mesial to the first row beads 32 suspended by the thread 34.

Progressive rows of beads 32 are added in a like manner traversing right to left and left to right. Alternately the beadwork process can commence on the opposite side of the embodiment and worked in a mirror image progression if the user so chooses.

User completes at least four rows of the desired Off-Loom bead weaving stitch then the beadwork can be disengaged from the embodiment of the apparatus 42 by releasing the thread 34 from the thread 34 engaging units or releasing the beads 32 from the bead 32 engaging units.

Since the user grasps 40 the apparatus 42 below the area that engages the thread 34 and the beads 32 the user sightline or view of the beads 32 is not impeded by the user fingers 40 as is the case with the traditional method of starting the stitch. Improved sightline may improve stitch formation and bead 32 color placement. Since the beads 32 are engaged by the apparatus 42 the beads 32 cannot rotate 38 out of color order which may also improve color placement accuracy.

I claim:

1. An apparatus for starting off-loom bead weaving stitches comprising:

a base comprising at least one flat plane and surface area sufficient for a user to grasp the base, an engaging filament configured to releasably retain beads extending across a length of said base, said engaging filament is retained substantially parallel to said base by releasable means to allow for attaching said beads in a specific sequence as required to construct the off-loom beadweaving stitches, wherein said engaging filament presses said beads against said base, and said engaging filament can be removed from said beads by said releasable means.

2. The apparatus of claim 1 wherein said engaging filament is attached to said base by movable means.

3. The apparatus of claim 2 wherein said movable means comprises a hinge or a pivot.

4. The apparatus of claim 3 wherein said base further comprises dimples to receive beads at a predetermined bead spacing.

5. The apparatus of claim 1 wherein said releasable means comprises a clasp.

6. The apparatus of claim 1 wherein said releasable means further comprises individual and independent units partially enclosed in a structure with openings and means to nutate said individual and independent units in and out of said structure.

7. An apparatus for starting off-loom beadweaving stitches comprising:

a plurality of units rotatable about an axis and having a first length on a first side of said axis and a second length on a second side of said axis wherein a width of said units corresponds to a bead width and the difference between said first length and said second length of said units provides a recess suitable for receiving and retaining a bead between said units, wherein a sequence of said units can each be rotated 180 degrees to present a pattern of alternating first length and second length sides to allow for attaching beads in a specific sequence as required to construct the off-loom beadweaving stitches.

8. The apparatus of claim 7 wherein said plurality of units are retained about said axis by means to join units to allow rotation.

9. The apparatus of claim 7 wherein said plurality of units are rod shaped and said first length is approximately one half bead height longer than said second length.

10. A device to retain beads for off-loom beadweaving comprising:

a flexible panel;

a plurality of voids arranged linearly in a central portion of said flexible panel to define a central folding axis;

said plurality of voids comprising a support side with a border parallel to said central folding axis;

a first grasping area on a first side of said central portion of said flexible panel and a second grasping area on a second side of said central portion of said flexible panel;

a plurality of bridge portions positioned mesial said plurality of voids;

wherein folding said flexible panel along said central folding axis intersecting said plurality of voids transforms each void into a recess, and presents said plurality of bridge portions on two sides of each recess, and each pair of said plurality of bridge portions is configured to removably retain a bead laterally;

said border parallel to said central folding axis comprises a horizontal support to retain a bead vertically; and wherein folding said flexible panel aligns said first grasping area adjacent said second grasping area for manual retention.

11. The device of claim 10 wherein each of said plurality of voids comprises a polygonal shape.

12. The device of claim 11 wherein said plurality of bridge portions are raised.

13. The device of claim 10 wherein said plurality of void comprises an access side having a border comprising an acute angle, wherein said acute angle extends further from said central folding axis than said support side to allow access below said horizontal support.

14. The device of claim 13 wherein said central folding axis is perforated.

15. The device of claim 10 wherein each of said plurality of voids comprises a pentagonal shape.

* * * * *